United States Patent [19]

Anger

[11] Patent Number: 4,674,205

[45] Date of Patent: Jun. 23, 1987

[54] STAMPED CUSHIONING PIECE IN THE FORM OF AN INSOLE OR OF AN INSERT PIECE FOR SHOES

[75] Inventor: Wolfgang Anger, Wedemark, Fed. Rep. of Germany

[73] Assignee: Nitex GmbH, Fed. Rep. of Germany

[21] Appl. No.: 582,304

[22] Filed: Feb. 22, 1984

[30] Foreign Application Priority Data

Feb. 24, 1983 [DE] Fed. Rep. of Germany ..... 3306425

[51] Int. Cl.[4] ..... A43B 13/38

[52] U.S. Cl. ..... 36/44; 36/30 R

[58] Field of Search ..... 36/43, 44, 30 R, 31, 36/71, 25 R, 28, 30 A, 32 R, 35 R, 114; 428/159, 316.6, 161

[56] References Cited

U.S. PATENT DOCUMENTS

| | | | |
|---|---|---|---|
| 2,760,281 | 8/1956 | Cosin | 36/44 X |
| 2,865,046 | 12/1958 | Bird | 428/159 X |
| 2,928,193 | 3/1960 | Kristan | 36/44 X |
| 3,301,741 | 1/1967 | Henrickson | 428/161 X |
| 3,416,245 | 12/1968 | Ferreira | 36/44 |
| 3,591,882 | 7/1971 | Pearsall | 36/44 X |
| 3,730,169 | 5/1973 | Fiber | 36/44 X |
| 4,054,706 | 10/1977 | Shapiro | 428/213 |
| 4,055,699 | 10/1977 | Hsiung | 36/44 |
| 4,130,948 | 12/1978 | Krug | 36/44 |
| 4,167,824 | 9/1979 | Wolpa | 36/44 |
| 4,240,214 | 12/1980 | Sigle et al. | 36/31 X |
| 4,273,820 | 6/1981 | Swietzer | 428/159 |
| 4,454,187 | 6/1984 | Flowers et al. | 428/159 |

*Primary Examiner*—Werner H. Schroeder
*Assistant Examiner*—T. Graveline
*Attorney, Agent, or Firm*—Lockwood, Alex, FitzGibbon & Cummings

[57] ABSTRACT

Described herein is a stamped cushioning piece of a two-layered latex foam, produced with paddings in various places from a latex foam of greater specific weight. First, a layer of latex foam of slight specific weight is applied to a textile carrying sheet. Into this, depressions are stamped, whereupon a second layer of latex foam, preferably of a high specific weight, is applied. Manufacture occurs continuously on so-called large-scale machines, and the pieces are stamped out of the sheet.

11 Claims, 6 Drawing Figures

STAMPED CUSHIONING PIECE IN THE FORM OF AN INSOLE OR OF AN INSERT PIECE FOR SHOES

DESCRIPTION

The invention concerns stamped cushioning pieces in the form of an insole, or of an insert, for shoes, made from latex foam coating products.

Processes are known for manufacturing form items from latex foam as cushionings for insertion, in shoes such as pads, wedges, heel pads, foot beds, and so on. Such shoe insert pieces are furthermore also used as cushionings for the ankle, Achilles heel, and the tongue. They further serve as insert pieces for shoe fillings and insoles.

These form items of latex foam still require at this time, however, a great deal of hand work, since the shaped sheets must be handled by hand, first for the gelling, then for the vulcanization, and then yet again for removing the shaped pieces. Afterwards, the edge of the shaped piece must still be cleaned. All of this is quite expensive in labor costs.

The shoe industry is therefore using to an increasing extent a latex foam coating product. This is more cost-effective to produce. The shoe factory receives this as a rolled product, in strengths and firmness appropriate to the purpose of use. These need only to be stamped out, and shoe factories are accustomed to stamping out materials from the roll. These stamped pieces naturally do not have transitions as unstable as form pieces. Since, however, a closely fitting covering is continuously drawn over the cushioning, which presses together the edges of the stamped pieces more strongly, a certain transition also arises in the external aspect.

This coating product can be spread on a textile or fleece, or also consist of only a latex foam.

This coated latex foam on textile or a fleece very much resembles that which is used for the manufacture of insoles. These insoles of latex foam—which, in contrast to shoe insert pieces, represent an object to be used independently—have, for reasons of the market, developed in many forms internationally over the past 30 years. They have different strengths, solidities, foam colors, textile or fleece carriers, perforations, admixtures of additives or aromatics, structured surfaces of the foam, and so on.

In order to afford optical contrasts, there are also soles with two foam layers of different colors.

These latex foam coating products are printed off, gelled, stamped as required, vulcanized, and rolled up on large rolls and in large quantities as piece goods, on machines of up to almost 100 meters length, without stop and by means of a ductor, and so at a uniform thickness. A textile or fleece serves as the carrier into which the foam is driven far enough in that the resistance to tearing there is no less than that of the foam itself. If it is desired to have the foam without the carrier, then it is spread on a conveyor sheet, the upper surface of which contains a releasing agent. In addition to insoles of latex foam, there exist shoe inserts of latex foam. There are also orthopedically adjusted to the individual foot, or are sold as trade items in different forms and sizes.

Similar to such shoe inserts for use as trade items, there are insoles in which one or several form items of latex foam made from coating products are affixed to the stamped piece as pads, flexible supports, heel pads, and so on. Manufacturing these insoles with localized reinforcements, which should give the foot additional support at these places, is more expensive because the manufacture of the form items requires a great deal of hand work and, in addition, there is the need for locally precise adhesion of the pads to the soles.

It is therefore the task of the invention to produce cushionings of latex foam as stamped pieces, similar to the above-described form pieces and similar to the insoles with reinforcements described last, solely by using the known coating process on large-scale machines.

This task is solved through the invention's characteristics and processes as specified herein.

The stamping occurs in the usual way, through a stamping roller, or through a flat-base stamp. During stamping, depressions arise through the compression of the foam. These are fully filled as the formed underside by means of the second coating with a specific heavier foam.

In attaining the goal of making the latex foam thicker, heavier, and therefore more capable of resisting molding pressure in some places rather than at others, it is beneficial that, even at the first layer of the foam, where it is stamped, it is also compressed, and therefore made more resistant.

The transitions in the form of the first layer, thus, between the foams of lower and higher thickness, are continuous and flowing, and so correspond to those in the form pieces of latex foam already known.

The latex foam piece goods thus obtained are now stamped out for the use goals already known. During stamping, the reference points necessary for stamping are obtained by means of conical deepened points.

The invention is especially advantageous for the manufacture of insoles, which contrast to those treated above through the special characteristics of locally differing thicknesses.

In accordance with the invention, an insole which has characteristics similar to the soles with stuck-on form pieces already described, is possible. It no longer has, however, the additional material levels which arise from the joining of the form pieces and the coating products, but instead has a height uniform over the entire sole.

For the manufacture of insoles of the type specified by the invention, the same process as is used in the stamping of the pieces is employed. First, an endless, one-layered latex foam coating product is manufactured, preferably on a textile carrier sheet, in a thickness which approximately corresponds to the thickness of the finished insole. The latex foam which is used for this first layer is, preferably, a foam of lower thickness, and therefore of lower specific weight; for example, a foam with a weight of 120 kg/m$^3$. This first coating of the continuously manufactured latex foam coating product is then gelled in the known manner, and the pattern of an insole, by means of a stamping roller, is stamped into this gelled form, in which the parts to be cushioned are represented as more or less deep insular impressions of increased solidity relative to the remaining areas of the first layer and with harmonious edge transitions, as necessary.

Where, for example, in the middle of the front part of the foot, a reinforcement of the insole is produced in the form of a heart-shaped pad, a heart-shaped depression is stamped at this spot, the edges of which gradually pass over again into the surface of the first coating.

In this matter, different impressions can be created in the contour of the insole. After stamping, the sheet is vulcanized. With a passage now through the large-scale coating machinery of the second layer, there arises a latex foam of greater thickness, and therefore of a higher or greater specific weight; for example, 360 kg/m$^3$.

It is now easy to see that the second layer not only causes the definitive and uniform thickness of the insoles, but also fills the insular depressions, which are were impressed in the first layer. The second latex foam coating is therefore the pouring material, which is poured in the form which is stamped into the first latex form coating. The second coating is then likewise gelled, and subsequently vulcanized in the known manner. Afterwards, the individual insoles are individually stamped out of the sheets the latter of which are twice coated and which already contain the finished insoles. The insole is then usually turned over as is normally the case. The carrier material then forms the upper side, if the insole is inserted into the shoe. The thicker foam layer lies on the bottom, with the reinforcements formed on it, and the reinforcements form elevations in the first, softer latex layer. They therefore have precisely the desired thickness and strength which they need to exhibit their supportive effect while wearing the shoe. The latex layers can be differently colored.

It should be noted that the relatively light foam of the first coating in the manufacture process is condensed during pressing, so that it comes closer to the heavier material of the coating. The compressed foam of the first coating process therefore likewise assists the desired goal, which is effected through the second coating process. In order to make the places of increased thickness visible to consumers, the soles can receive a color printing there. While printing these spots, one can, apart from the color, also add other characteristics; for example, by supplying additives or aromatics.

Through the invention, the insoles can receive characteristics other than those described. The piece goods, out of which the soles are stamped, receive, uniformly distributed over the entire surface, a stamping in the first layer in the form of straight grooves, grooves in waving lines, or in zigzags, grids, naps, or the like. Thus, massage effects can be attained by means of the insoles.

It is also possible within the framework of the invention to attain, through the choice of the layer thicknesses, various support and resilience values.

For a better understanding, the invention will now be illustrated by means of an example of execution, which is depicted in the drawing as follows.

Figure 1:
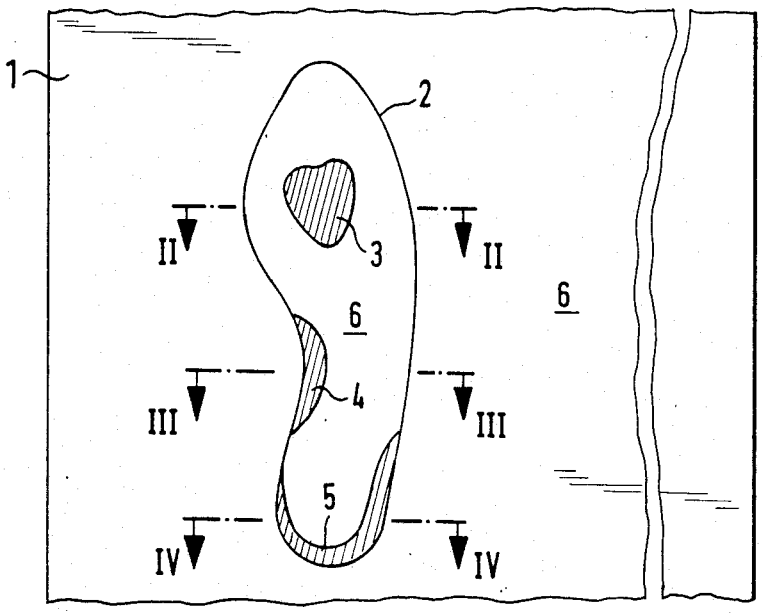
FIG. 1 is a section with impressions into an insole, is in a continuously produced, relatively broad latex foam coating product.

In FIG. 1, reference (1) depicts an endlessly produced latex foam material or coating material of considerable width. This coating material consists of a carrier material, on the upper side of which the foam is applied.

This latex foam is of slight thickness; its specific weight amounts, for example, to 0.12 g/cm$^3$. This sheet (1), with the first latex foam layer lying on it, is then stamped corresponding to the insole desired. In FIG. 1, the boundary thickness (2) is the outer contour. At (3), a pad is positioned; here, it should be stamped deeply, and likewise at (4) and at the heel (5). At (3, 4, 5), impressions in the foam represented, with the desired transitions to the surface (6), correspond to the first latex foam layer. In FIG. 1, only one such insole is depicted on the sheet (1); In reality, however, about 20 such pressings are accomodated next to one another in the latex foam layer, and are used for either the right sole or for the left sole.

Figure 2:
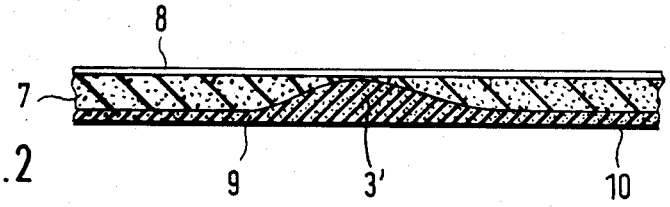
FIG. 2 is a section along the line II—II, in FIG. 1.
Figure 3:
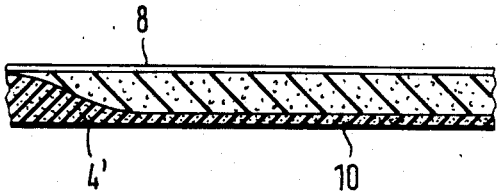
FIG. 3 is a section along the line III—III in FIG. 1.
Figure 4:
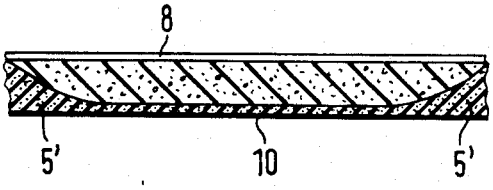
FIG. 4 is a section along the line IV—IV, in FIG. 1.

In FIGS. 2, 3, and 4, it is schematically shown how these impressions and the second latex foam coating, still to be introduced, look in a cross section. The first foam layer is the layer (7), which lies on the carrier material of the textile type (8). The impression (3) is shown at 3' in FIG. 2. Here, as also shown in the FIGS. 3 and 4, the above-mentioned second latex foam is already applied. This is shaded dark, and bears the reference mark (9). The second layer coating fills out the impression (3, 4, 5), and simultaneously forms the upper, smooth sealing coating, as can especially be seen at (10) in FIG. 3.

It should be noted that, in FIGS. 2 and 4, the insole is already turned over, as described above, so that the textile carrier layer now forms the upper layer of the insole.

The last-coated, second latex foam layer (10), now forms the lower layer with a thicker material, preferably with a specific weight of 360 kg/m$^3$. It can now be clearly seen from the section depictions 2 and 4 how the thicker, and thus more solid, latex foam masses at 5' support the heel at both sides, and how, according to FIG. 2, the middle pad-shaped elevation at 3' supports the forward foot sole.

As shown above, the invention can also be used for the manufacture of insert pieces. This is shown in FIGS. 5 and 6, and will be described as follows.

Figure 5:
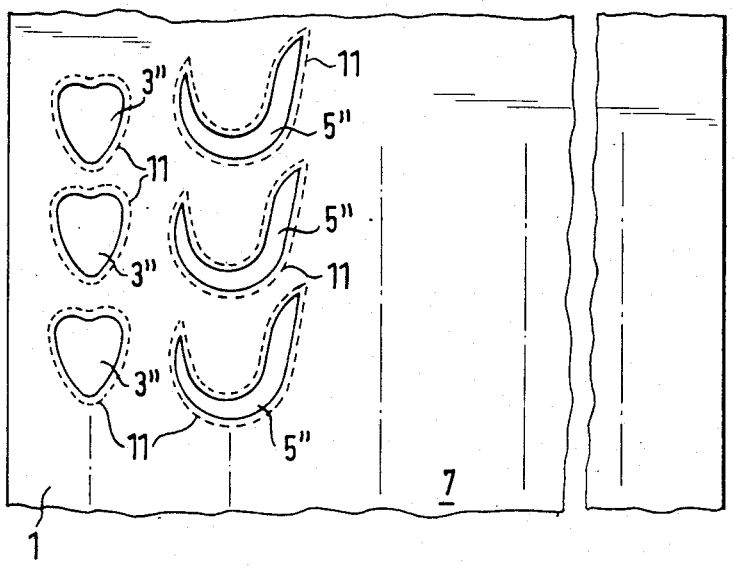
FIG. 5 is a section, similar to FIG. 1, for the manufacture of insert pieces.
Figure 6:
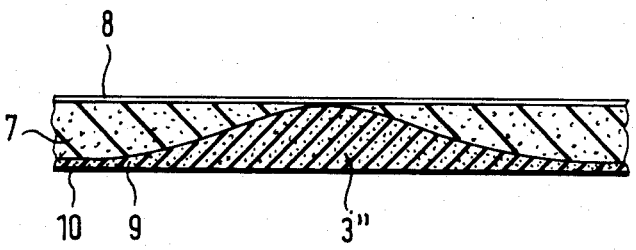
FIG. 6 is a stamped-out insert piece.

FIG. 5 corresponds to FIG. 1 to the manufacture of insoles; however, in the first latex foam layer (7), impressions occur in the form of insert pieces, namely, heart-shaped pads at 3'', corresponding to the pad (3) in the insole in FIG. 1, and heel-supporting insert pieces (5'') corresponding to the piece (5) in the insole, in accordance with FIG. 1. These insert pieces are naturally arranged for the best utilization of the materials sheet, and are then stamped out along the dotted lines (11), so that, as shown enlarged in FIG. 6, an insert piece is maintained in the form of a pad or of a heel reinforcer. The cross-hatching in FIG. 6 is the insert piece which is produced, preferably from a thicker, specifically heavier, latex foam, and (7) shows the remainder of the form.

This form is, as described above, formed specifically of light latex foam, and, during insertion, is so pressed together that only one thin layer remains on the upper side of the specific insert piece.

I claim:

1. A cushioning piece comprising:

a textile carrier sheet;

a first layer of latex foam on said carrier sheet; said first layer being stamped to define at least one compressed area therein; and a second layer of latex foam coated on said first compressed layer, said second layer overlying said compressed area and being thicker at said compressed area.

2. The cushioning piece of claim 1, wherein said stamped compressed area of said first layer is insular.

3. The cushioning piece of claim 1, wherein at least one of said layers includes a color pigment.

4. The cushioning piece of claim 1, wherein said compressed area is of increased solidity relative to the remaining areas of said first layer and said cushioning piece is colored to mark at least one of the areas.

5. The cushioning piece of claim 1, wherein said cushioning piece is in the shape of a shoe insole.

6. The cushioning piece of claim 1, wherein the thickness of said cushioning piece is uniform.

7. The cushioning piece of claim 1, wherein said second layer of foam is of greater specific weight than said first layer.

8. The cushioning piece of claim 7, wherein said stamped compressed area of said first layer is insular.

9. The cushioning piece of claim 10, wherein the thickness of said cushioning piece is uniform.

10. The cushioning piece of claim 8, wherein said compressed area is of increased solidity relative to the remaining areas of said first layer and said cushioning piece is colored to mark at least one of the areas.

11. The cushioning piece of claim 10, wherein said cushioning piece is in the shape of a shoe insole.

* * * * *

UNITED STATES PATENT AND TRADEMARK OFFICE

CERTIFICATE OF CORRECTION

PATENT NO. : 4,674,205

DATED : June 23, 1987

INVENTOR(S) : Wolfgang Anger

It is certified that error appears in the above-identified patent and that said Letters Patent is hereby corrected as shown below:

Column 1, line 5, delete the comma "," and after "shoes" insert a comma --,--.
Column 3, line 3, delete "a".
Column 3, line 20, after "The" insert --textile--.
Column 3, line 53, delete "is" (second occurrence).
Column 4, line 8, delete the semicolon ";" and insert a period --.--

Signed and Sealed this

Third Day of November, 1987

*Attest:*

*Attesting Officer*

DONALD J. QUIGG

*Commissioner of Patents and Trademarks*